United States Patent [19]

Goto et al.

[11] 4,253,646

[45] Mar. 3, 1981

[54] HOT BLAST-FURNACE-LINING REPAIRING APPARATUS

[75] Inventors: Kanji Goto, Kamaishi; Tiyomi Yamaguti, Sakuragi; Yorihito Mikami; Rokuro Komakine, both of Kamaishi, all of Japan

[73] Assignee: Nippon Steel Corporation, Tokyo, Japan

[21] Appl. No.: 75,672

[22] Filed: Sep. 13, 1979

[30] Foreign Application Priority Data

Oct. 9, 1978 [JP] Japan ..... 53/123567
Oct. 9, 1978 [JP] Japan ..... 53/123568

[51] Int. Cl.[3] ..... C21B 7/04
[52] U.S. Cl. ..... 266/281; 266/271
[58] Field of Search ..... 266/271, 272, 273, 281, 266/287

[56] References Cited

U.S. PATENT DOCUMENTS 4,099,708 7/1978 Morris et al. ..... 266/281
4,108,384 8/1978 Egli ..... 266/281
4,163,546 8/1979 Morris et al. ..... 266/281

*Primary Examiner*—L. Dewayne Rutledge
*Assistant Examiner*—John P. Sheehan
*Attorney, Agent, or Firm*—Wenderoth, Lind & Ponack

[57] ABSTRACT

A hot blast-furnace lining relining apparatus has a holding member that is to be horizontally inserted through an opening near the top of a blast furnace, a collapsible arm member held by the holding member, and a nozzle attached to the tip of the arm member for gunning monolithic materials onto such part of the furnace as requires repair. With the furnace load lowered below the point to be repaired, the arm member is inserted into the furnace, and then expanded. The gunning nozzle, which is directed to the damaged part of the furnace wall and rotated about the furnace axis, sprays monolithic materials onto the furnace linings to carry out the repair. On completion of the repair, the arm member is folded and taken out of the furnace.

14 Claims, 8 Drawing Figures

HOT BLAST-FURNACE-LINING REPAIRING APPARATUS

BACKGROUND OF THE INVENTION

This invention relates to an apparatus for repairing the stack linings of operating blast furnaces from the inside.

The thickness of the stack linings of a blast furnace decreases with length of service. If such furnace is kept in continuous operation, abnormal localized erosion or flaking of the refractory linings may result, depending on the in-furnace thermal load conditions, which, in turn, leads to imposition of excess thermal load on the steel shell and/or coolers in the affected zone.

As a consequence, a hot spot or crack may occur in the steel shell and cause gas leakage and other disadvantages.

To remedy these difficulties, the blast furnace must be shut down for a long period of time, with inevitable lowering of its utilization rate and great economic loss.

To solve this problem, the cause of such difficulties must be eliminated and the linings of the blast furnace repaired.

Conventional blast-furnace lining repairing methods can be classified into the following two major categories:

METHOD A

Repairing of the blast furnace is done by a repairman or repairmen who enter the furnace after its change or load has been lowered, with the load surface solidified to prevent gas leakage, and the furnace temperature lowered to a level accessible to men. The furnace is brought into operation again when the repaired linings has been dried and the furnace temperature is raised to the original level.

METHOD B

If a hot spot or crack occurs in the steel shell of a blast furnace, or any thermocouple on the furnace wall detects abnormal temperature rise, an opening is made in the affected area from outside. Through this opening is inserted a nozzle to apply monolithic materials, slurried with water, at the required pressure. When the applied materials has been solidified, the opening is closed.

Method A requires a long preparatory time, since the repairing work is not started until measures have been taken to prevent the gas leakage from the lowered load surface and the furnace temperature has been lowered to an accessible level.

Despite such precautions with respect to furnace gas and temperature, the repairing work must be conducted by men in detrimental and hazardous environment.

Before resuming the furnace operation, a long additional period of time is required for raising the furnace temperature and this causes considerable economic loss.

Method B is advantageous in that the repairing can be conducted without stopping the furnace operation. It is disadvantageous, however, in that it is incapable of preventing the occurrence of such difficulties as hot spots and cracks the condition of which cannot be determined and position until they have occurred or advanced appreciably.

Moreover, the method is uneconomical since it requires many thermocouples to assure high accuracy in the determination of the condition and position of the hot spot or crack.

Also, since the repair is accomplished by simply injecting monolithic materials from the outside, the method does not permit determination of whether the damage has been properly remedied. Another disadvantage of the method is that it involves making many openings in the steel shell which, though closed ultimately, lower the shell strength.

There are some repairing units designed for partial insertion in a blast furnace. The inserted portion is remote-controlled from outside. This type of unit permits repairing to be conducted in a relatively high-temperature furnace atmosphere at, for example, 200° to 400° C. However, these units also involve the following problems: First, a manhole or other opening through which the unit can be is inserted must be provided near the furnace top, so that the distance between the opening and the point to be repaired becomes as great as about 15 to 20 m. To cover this distance, the unit must have a large holder, which, however, makes its insertion through the opening difficult. Second, the great distance between the opening and the repairing point makes it difficult the remote-control the unit from outside the furnace. To be more specific, it becomes difficult to direct the repairing unit exactly toward the damaged place and apply repairing materials economically and without missing any areas requiring repairing.

SUMMARY OF THE INVENTION

This invention successfully solves the aforementioned problems encountered in the repairing of damaged blast-furnace linings.

One object of this invention is to provide a hot blast-furnace-lining repairing apparatus that is capable of hot repairing the damaged linings of a blast furnace from inside without fully stopping the operation of the furnace.

Another object of this invention is to provide a hot blast-furnace-lining repairing apparatus that can be readily put in the furnace through an opening of limited size near the furnace top and controlled from outside.

Still another object of this invention is to provide a hot blast-furnace-lining repairing apparatus that can be directed exactly toward the point to be repaired perform repairing economically and without missing any areas requiring repairing.

In order to achieve the aforementioned objects, a hot blast-furnace-lining repairing apparatus according to this invention comprises a holding member that is to be horizontally inserted through an opening near the top of a blast furnace, a collapsible arm member supported by the holding member, and a nozzle attached to the tip of the arm member for gunning monolithic materials onto the part of the furnace that requires repairing.

On being put in the furnace, the arm member is expanded. The gunning nozzle is directed to the damaged part of the furnace linings and rotated about the furnace axis. While being rotated, the gunning nozzle sprays monolithic materials onto the furnace linings to carry out repairing. On completion of the repairing work, the arm member is folded and taken out of the furnace.

The hot blast-furnace lining repairing apparatus of this invention is suited for repairing the refractory linings between the middle and lower sections of the stack, or an area between about 15 and 20 m away from the stockline, which is liable to be damaged especially heavily during a long period of service.

To make effective use of the apparatus according to this invention, the refractory linings must be exposed periodically or as required during ordinary operation by means of the lowering of the furnace change or load to a desired level.

Thus, the temperature of the furnace atmosphere is maintained between 200° and 400° C. On detecting the surface temperature of an exposed cooler or determining the exact condition and position of damage in the refractory linings at 200° to 400° C., the gunning nozzle applies monolithic materials to the damaged area to accomplish hot repairing.

BRIEF DESCRIPTION OF THE DRAWINGS

FIG. 5(*a*) shows the condition before insertion; FIG. 5(*b*) shows a first arm let down into the furnace; and FIG. 5(*c*) shows a second arm expanded.

DETAILED DESCRIPTION OF THE PREFERRED EMBODIMENTS

Now preferred embodiments of this invention will be described by reference to the accompanying drawings.

Figure 1:
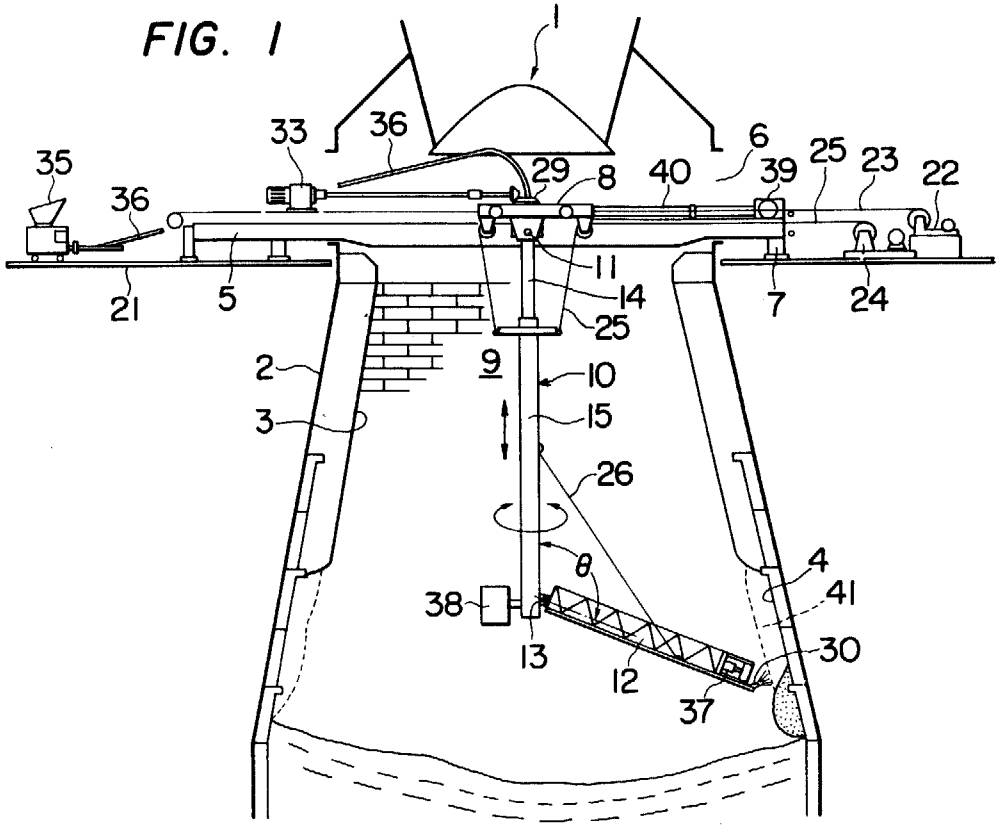
FIG. 1 is a front view showing an embodiment of the repairing apparatus of this invention in service.

FIG. 1 shows a repairing apparatus according to this invention mounted on a blast furnace. As seen, the blast furnace has a raw-materials charging appliance 1 on the top thereof. The body of the blast furnace comprises refractory linings 3 made up of refractory bricks laid inside a steel shell 2, with coolers 4 provided in the refractory linings 3.

Reference numeral 5 designates a guide frame or support member temporarily laid substantially horizontally over the furnace so as to pass through the center thereof. The guide frame 5 is passed through an opening, such as a manhold 6, provided in the steel shell 2 between the raw-materials charging appliance 1 and furnace linings 3, and is fastened to a stand 7. Reference numeral 8 denotes a moving device or suspension member movable, by means of wheels etc., along a guide member (rail) attached to the guide frame 5.

The moving device 8 carries a collapsible arm member 9 extending along the guide frame 5. More specifically, one end of an expandable first arm 10 is pivotally connected, with a shaft 11, to the bottom of the moving device 8, with a second arm 12 pivotally connected, with a shaft 13, to the other end of the first arm 10. The first arm 10 comprises, for example, a telescopic tube which consists of an inner tube 14 and an outer tube 15. The length of the first arm 10 is increased or decreased by moving the inner tube 14 and outer tube 15 relative to each other.

Figure 2:
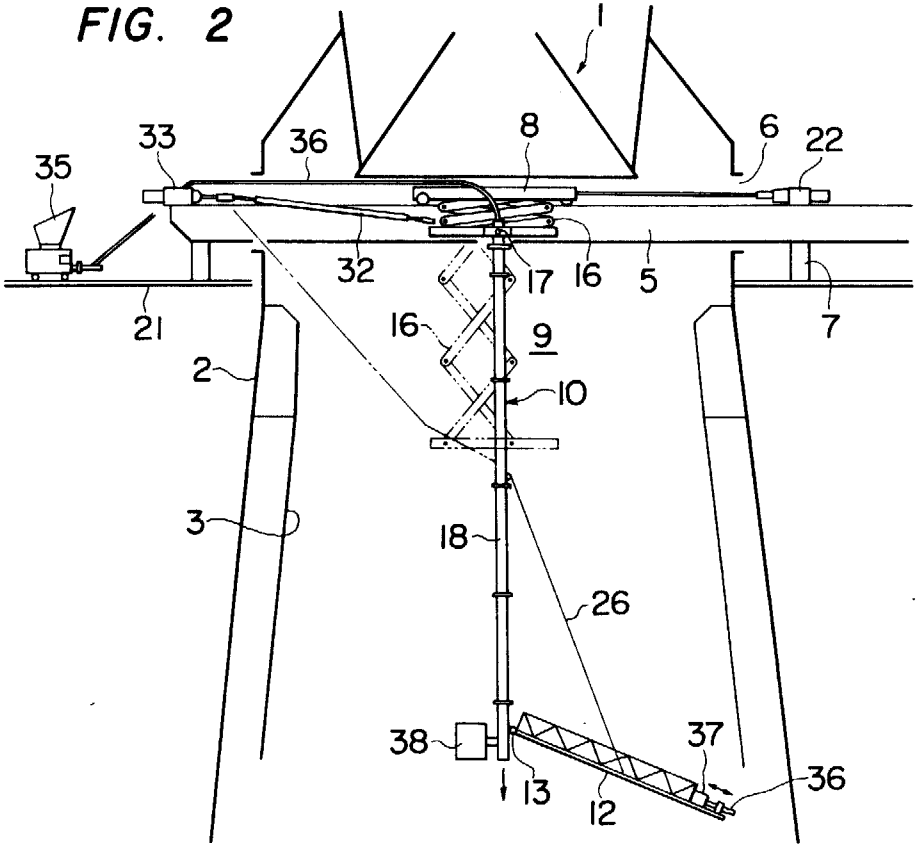
FIG. 2 is a front view of another embodiment of this invention in service.
Figure 4:
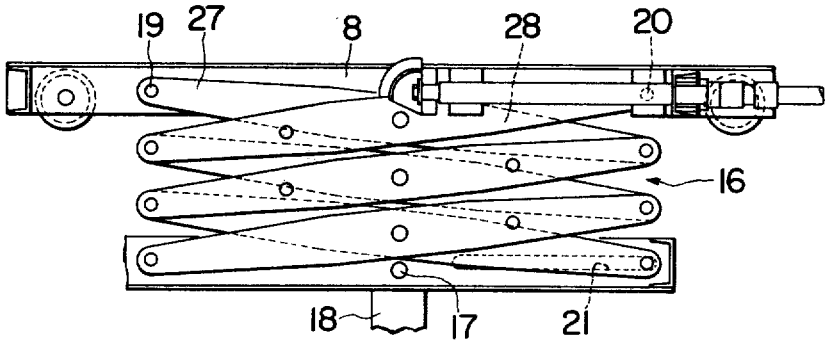
FIG. 4 is a detailed front view showing a moving device and a pantograph mechanism of the apparatus of FIG. 2.

Another type of collapsible arm member 9 is shown in FIGS. 2 and 4. The upper end of a first arm 10, comprising a pantograph mechanism 16 and a support 18 pivotally fitted thereto with a shaft 17, is pivotally connected, with shafts 19 and 20, to the bottom of the moving device 8, with a second arm 12 pivotally connected, with a shaft 13, to the lower end of the first arm 10.

Figure 5A:
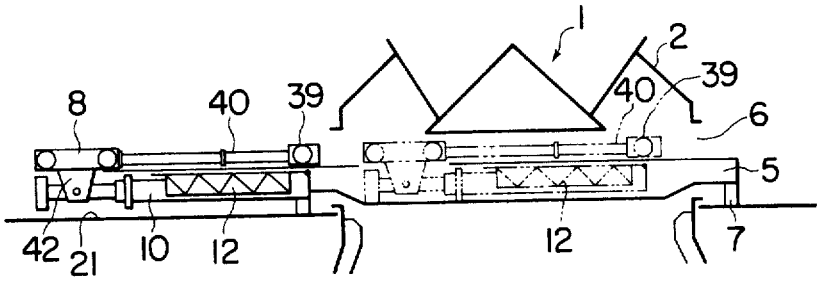
FIG. 5 explains the steps followed in inserting the apparatus of FIG. 1 into a blast furnace.
Figure 5B:
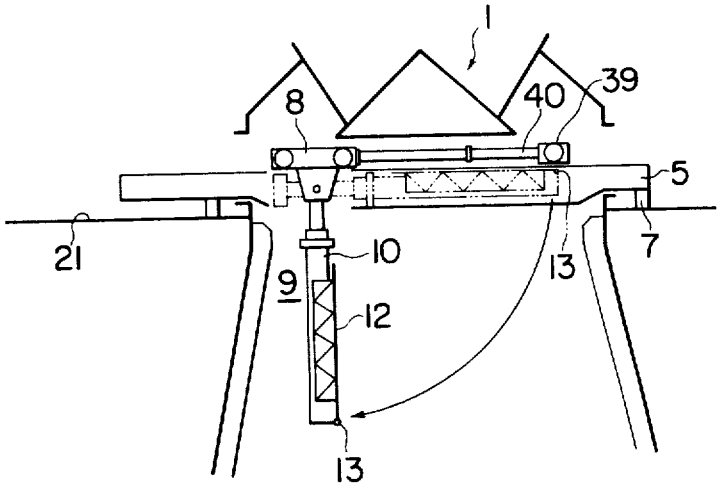
Figure 5C:
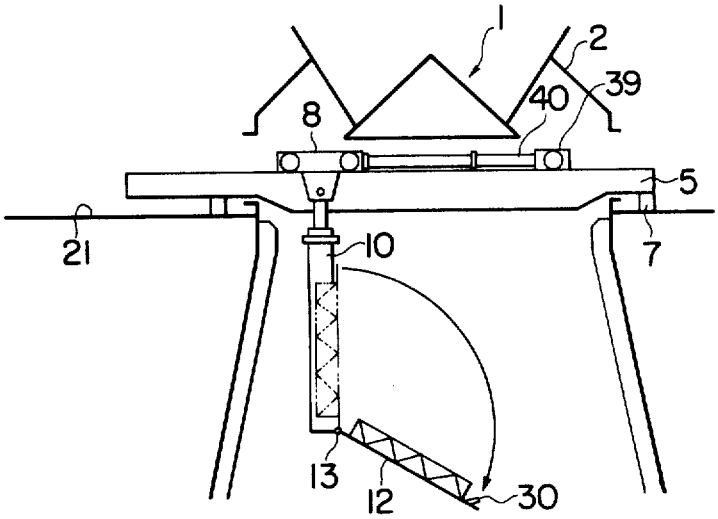

When folded around the shafts 11 and 13, the collapsible arm member 9 can be put in and out through the manhold 6 along with the moving device 8, as shown in FIG. 5(*a*).

The moving device 8 is interlinked by a wire 23 with a drive unit 22 on a working floor 21 outside the furnace. The moving device 8 is moved along the guide frame 5 by the forward and backward operation of the drive unit 22.

Reference numeral 24 denotes an elevating drive unit on the working floor 21. A wire 25 connected to this drive unit 24 is fastened to the top of the external tube 15 of the first arm 10. The first arm 10 is expanded and shortened by paying out and taking up the wire 25. The first arm 10 can be folded about the shaft 11.

A wire 26 connected to the drive unit 24 is fastened to a midway point on the second arm 12. By taking up or paying out the wire 26, the second arm 12 can be folded or opened through a desired angle $\theta$ around the shaft 13.

FIG. 4 shows details of the first arm 10 which comprises the moving device 8, support 18, and pantograph mechanism 16. In this figure, the pantograph mechanism 16 is folded. Uppermost link arms 27 and 28 of the pantograph mechanism 16 are pivotally attached to the moving device 8 with the shafts 19 and 20. The end of the link arm 28 which is pivoted on the shaft 20 is slid within a given range in the longitudinal direction of the moving device 8 by means of, for example, a cylinder. This sliding motion expands and withdraws the pantograph mechanism 16 as indicated by a dot-dash line in FIG. 2.

Reference numeral 26 designates a rotating mechanism for directing a gunning nozzle 30 toward the furance linings 41 requiring repairing.

Figure 3:
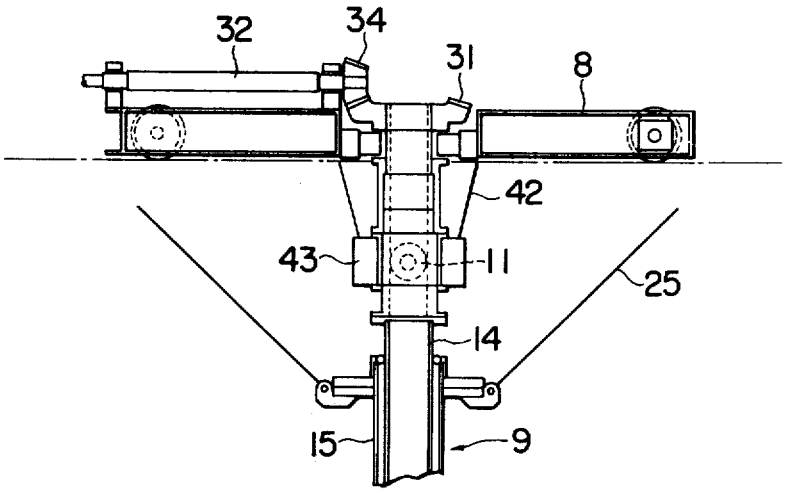
FIG. 3 is a detailed cross-sectional view showing a joint between a moving device and an arm member of the apparatus of FIG. 1.

FIG. 3 is a detailed view of the rotating mechanism 29 attached to the joint between the moving device 8 and the first arm 10.

Using the shaft 11, a bearing member 43 is connected to a bracket 42 fastened to the bottom of the moving device 8. The bearing member 43 supports the arm member 9. A bevel gear 31, fastened to the first arm 10 of the arm member 9, is engaged with a gear 34 connected through a transmission shaft 32 to a rotating unit 33 outside the furnace. More specifically, the bevel gear 31 is fastened to the top of the internal tube 14 of the first arm 10. The gear 34, adapted to engage with the bevel gear 31, is fastened to the tip of the transmission shaft 32 of the rotating unit 33. The rotating unit 33 rotates the first arm 10 about its axis through the transmission shaft 32, gears 31 and 34. The gear 31 is engaged with the gear 34 by being drawn near the gear 34 together with the transmission shaft 32 after the released arm member 9 has entered the furnace as shown in FIG. 5(*b*). By reversing the above procedure, the gears 31 and 34 are disengaged as the arm member 9 is folded and taken out of the furnace as shown in FIGS. 5(*c*) back through 5(*a*).

Though not shown, another embodiment of the rotating mechanism 29 of the arm member 9 many employ a chain and sprocket coupling for the rotating unit 33.

Reference numeral 35 designates a monolithic materials feeder provided on the working floor 21 outside the furnace. The rear end of a pressure hose 36, leading through the arm member 9 to the gunning nozzle 30, is connected thereto.

As shown, an expanding device, such as a hydraulically operated piston cylinder 37, is fitted to the second arm 12. The gunning nozzle 30 is connected to the piston cylinder 37 so that the position thereof with respect to the damaged surface can be adjusted easily by the expansion and contraction of the cylinder 37. Provision of a counter weight 38 to the lower side of the first arm 10, disposed opposite to the second arm 12, permits the performance of well-balanced repairing operations.

Reference numeral 39 designates an auxiliary trolley connected through a connecting member 40 to the moving device 8. The auxiliary trolley 39 holds the folded arm member 9 substantially parallel to the guide frame 5 before the arm member 9 is inserted in the furnace. The moving device 8 moved to the furnace center is fixed thereat by detaching the auxiliary trolley 39 from the connecting member 40 and fastening the end of the connecting member 40 to the guide frame 5 while the unfolded arm member 9 is expanded and lowered.

Figure 6:
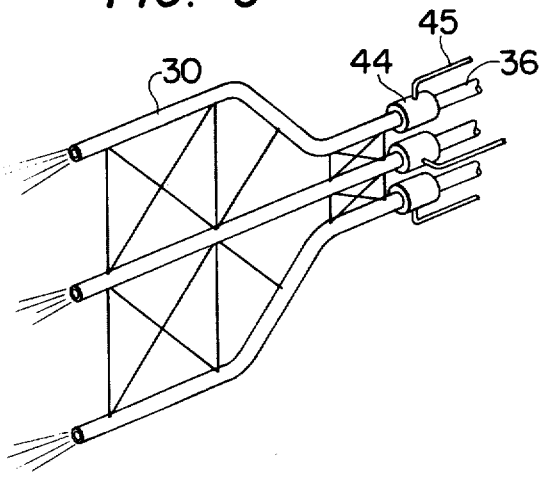
FIGS. 6 and 7 are perspective views of a plurality of gunning nozzles arranged vertically and horizontally.
Figure 7:
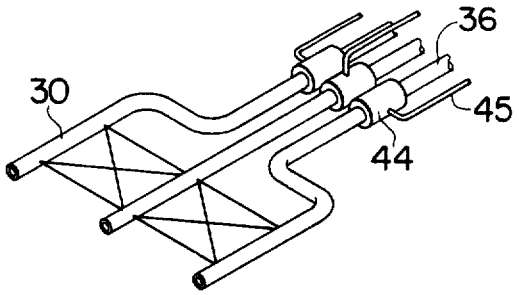

The gunning nozzle 30 can be provided on the second arm 12 of the arm member 9 in several ways. For example, as shown in FIG. 6, three gunning nozzles 30 may be arranged vertically at suitable intervals. This method permits application of gunning materials over a great width, which permits a sharp reduction in working time. Or three gunning nozzles 30 may be spaced horizontally, as shown in FIG. 7. This arrangement permits application of a thick coating of gunning materials.

When a plurality of gunning nozzles are provided as described above, gunning can be continued uninterruptedly even if some of the nozzles becomes clogged, using the unclogged nozzles.

The gunning nozzle 30 for applying gunning materials is of the ordinary type. As shown in FIGS. 6 and 7, the nozzle 30 is connected through a water-adding ring 44 to the pressure hose 36. The water-adding ring 44 is connected to a water hose 45. Using compressed air, the gunning materials feeder 35 supplies materials powder to the water-adding ring 44, where the powder is mixed with water to form pasty materials that is sent to the gunning nozzle 30.

The following paragraphs describe how the above-described repairing apparatus is put in the blast furnace and how a damaged furnace lining is repaired.

To put the repairing apparatus in a simple blowing-down blast furnace with its change or load lowered, the guide frame 5 is laid horizontal and fixed over the opening 6 at the furnace top, as shown in FIG. 5(*a*). Then, the moving device 8, auxiliary trolley 39, first arm 10, second arm 12, and gunning nozzle 30 are pre-assembled on the working floor 21, and attached to the guide frame 5. In this state, the second arm 12 is folded alongside the first arm 10, as indicated by solid lines in FIG. 5(*a*), with the first arm 10 held substantially parallel to the guide frame 5 by the moving device 8 and auxiliary trolley 39. Namely, the first arm 10 is held rotatably about the shaft 11, with that side thereof on which the second arm 12 is folded caught by the auxiliary trolley 39. When the drive unit 22 drives the moving device 8, the auxiliary trolley 39 moves in the same direction while carrying the second arm 12 until stopped at a desired position (near the charging side of the guide frame) in the furnace (as indicated by dot-dash lines in FIG. 5(*a*)).

Then, the arm member 9 is detached from the auxiliary trolley 39, and turned downward to a position indicated by solid lines in FIG. 5(*b*) by moving the wire 25 by the elevating drive unit 24. If the first arm 10 is not long enough, the external tube 15 is lowered to increase the length. By operating the wire 26, the second arm 12 is turned through a desired angle $\theta$ about the shaft 13 (FIG. 5(*c*) so that the tip of the gunning nozzle 30 is directed toward a damaged part 41 shown in FIG. 1.

The optimum distance between the gunning nozzle 30 and the damaged part 41 can be selected by adjusting the cylinder 37, considering the properties of the gunning materials, the quantity of water added, the gunning pressure, the furnace linings temperature, and other conditions.

In the case of conducting localized repairwork, the distance between the gunning nozzle 30 and the damaged part 41 can be adjusted by use of not only the cylinder 37 but also the moving device 8.

The above procedure places the gunning nozzle 30 in position ready for gunning materials. Some blast furnaces call for only partial repairing, which others require full circular repairing. Partial repairing can be achieved even if the first arm 10 is positioned as shown in FIG. 5(*c*). Whether the repairing is to be partial or full circular, however, it is desirable to move the first arm 10 from the position indicated by solid lines in FIG. 5(*b*) to the furnace center as shown in FIG. 1, using the moving device 8. With the first arm 10 fixed thereat, the second arm 12 is turned to position the gunning nozzle 30 ready for applying gunning materials. When repairing circularly, the rotating drive unit 33 is operated to rotate the first arm 10 about the furnace axis through the gears 31 and 34. When repairing vertically, the elevating drive unit 24 is operating to adjust the length of the arm member 9. These operations permit repairing any part of the exposed blast furnace stack linings.

The gunning nozzle 30 sprays gunning materials supplied from the feeder 35 through the pressure hose 36. Addition of water to gunning materials near the gunning nozzle 30 is conductive to preventing the clogging of the pressure hose 36.

Higher precision repairing can be achieved if a furnace profile sensor, not shown, is provided at the tip of the second arm 12 along with the gunning nozzle 30 to determine the damage and repair conditions. Further, if this sensing device is interlocked with the drive unit 24 of the arm member 9 and the gunning materials feeder 35, the entire repairing work can be mechanized and automated. Because the repairing apparatus of this invention is used for hot-repairing blowing-down blast furnaces, that part of the apparatus, especially the arm member 9, which is put into the furnace may be cooled by suitable means.

When the damaged furnace interior has been fully repaired, the second arm 12 is folded, the moving device 8 is moved toward the opening 6, and the first arm 10 is raised, foldingly turned toward the guide frame 5 so as to extend parallel thereto, caught by the auxiliary trolley 39 at one end, and taken out of the furnace by moving the moving device 8, reversing the previously described charging procedure.

Figure 8:
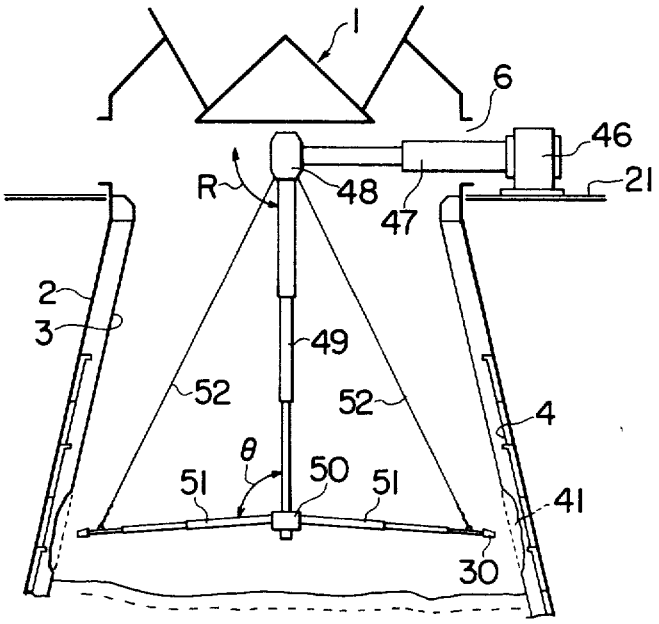
FIG. 8 is a front view showing still another embodiment of this invention in service.

FIG. 8 shows still another embodiment of this invention. In the embodiments shown in FIGS. 1 and 2, the guide frame 5 radially extends across the blast furnace. By contrast, this embodiment has a cantilevered horizontal arm or suspension member 47, which corresponds to the guide frame 5 but does not extend fully across the furnace. This contributes to the reduction of the apparatus size. As shown in FIG. 8, the expandable horizontal arm 47 extends toward the furnace center from a movable support member 46 on the working floor 21. The horizontal arm 47 carries a holding member 48 at the tip thereof, from which an expandable first arm 49 is suspended so as to be rotatable about the axis thereof. The upper end of the first arm 49 is hinged to the holding member 48 so as to be rotatable in the direction of the arrow R. The holding member 48 contains mechanisms (not shown) for rotating and hinging the first arm 49.

The first arm 49 carries a coupling member 50 at the lower end thereof, to which a pair of expandable second arms 51 are hinged. A gunning nozzle 30 is fastened to the tip of each second arm 51. A cordlike member 52, comprising a wire or chain, is connected close to the tip of each second arm 51 at one end thereof, and is fixedly wound around an in-and-out drum (not shown) contained in the holding member 48. By taking up or paying out the cordlike member 52, the second arm 51 is inclined at a desired angle $\theta$, or folded along the first arm 49.

This embodiment is operated in the same manner as those shown in FIGS. 1 and 2. When putting the second arm 51 in the furnace, the horizontal arm 47, first arm 49 and second arm 51 are shortened, the second arm 51 is folded along the first arm 49, and the first arm 49 is horizontally projected from the horizontal arm 47. By advancing the support 46, the shortened first arm 49 is inserted in the furnace from the tip thereof. On reaching a given position, the first arm 49 is turned downward, then the horizontal arm 47 is expanded so that the upright first arm 49 is positioned at the furnace center. The second arm 51 is unfolded from the first arm 49 by way of the coupling member 50 so that the gunning nozzle 30 is positioned opposite to the damaged part 41. The first arm 49 and second arm 51 are taken out of the furnace by reversing the above procedure. Having two sets of gunning nozzles 30 directed opposite to each other, this embodiment can double the gunning rate, shorten the working time, and maintain the balance of the apparatus.

Gunning material is supplied from a pressure feeder outside the furnace through a hose (neither shown) to the gunning nozzle 30. The hose is passed through the horizontal arm 47, first arm 49 and second arm 51 so as to be kept out of direct contact with the high-temperature atmosphere gas.

The two second arms in this embodiment may be reduced to one, or changed to be of the non-expandable type, as with the embodiments of FIGS. 1 and 2. Conversely, the one second arm in the embodiments of FIGS. 1 and 2 may be increased to two, or changed to be of the expandable type.

As is evident from the above description, the repairing apparatus of this invention is inserted into the furnace to perform hot repairing. Unlike the conventional repairing method A mentioned before, operation of the present invention does not require a long furnace shutdown time. A furnace requiring repair is simply blowing down, repaired in a short period of time, and brought back to normal operation immediately. Moreover the repairmen are freed from the bad environment of in-furnace work. Further, this method performs repairing while ascertaining the position and extent of damage from inside the furance, without making many openings in the steel shell from outside as is done in the conventional method B. This insures good, durable repairs and high utilization of gunning materials.

Being collapsible, the repairing apparatus of this invention, which is expanded to a larger size in use, can be put in the furnace through a small opening in the top thereof. Therefore, this apparatus can be applied to the existing furnaces without requiring any modification. In addition, this apparatus is adapted to gunning materials onto inclined furnace linings at the most desirable distance. All these features make it possible to repair any part of the blast furnace, reliably and easily.

What is claimed is:

1. An apparatus for hot repairing a damaged portion of a lining of a blast furnace with the charge of the blast furnace lowered below the damaged portion, said apparatus comprising:

support member means adapted to be supported by a working floor exterior of a blast furnace at a position adjacent the top thereof;

a suspension member supported by said support member means to extend horizontally and adapted to be extended thereby through an opening in the top of the blast furnace so that said suspension member is positioned within the blast furnace;

a first arm having first and second spaced opposite ends and a longitudinal axis, said first end being pivotally connected with respect to said suspension member about a horizontal pivot, such that said first arm is rotatable about said pivot between a horizontal first position extending substantially parallel to said suspension member and a substantially vertical second position extending downwardly into the blast furnace, said first arm being mounted for rotation about said longitudinal axis thereof;

a second arm having first and second spaced opposite ends, said first end of said second arm being pivotally connected to said second end of said first arm, such that said second arm is pivotable between a first position extending parallel to and folded along said first arm and selected second positions extending at desired angles with respect to said first arm;

gunning nozzle means mounted at said second end of said second arm for discharging material for repairing a damaged portion of the blast furnace;

rotating means for rotating said first arm about said longitudinal axis thereof;

first drive means for moving said first arm between said first and second positions thereof;

second drive means for moving said second arm between said first and second positions thereof; and supply means for supplying repair material from a position exterior of the blast furnace to said nozzle means.

2. A hot repairing apparatus as claimed in claim 1, wherein said support member means is adapted to extend across the blast furnace and passes through the furnace center and two opposite openings therein, said suspension member comprises means moving horizontally along said support member means, and said first arm is attached to said moving means.

3. A hot repairing apparatus as claimed in claim 2, wherein said first arm is attached to said moving means through a vertically expandable pantograph mechanism.

4. A hot repairing apparatus as claimed in claim 2, wherein said suspension member is expandable, is adapted to be cantilevered into the furnace through a single opening therein, and has a tip carrying said first arm.

5. A hot repairing apparatus as claimed in claims 1, 2, 3 or 4, wherein said first arm is expandable.

6. A hot repairing apparatus as claimed in claims 1, 2, 3 or 4, wherein said second arm is expandable.

7. A hot repairing apparatus as claimed in claims 1, 2, 3 or 4, wherein said first drive means comprises a cord-like member having a first end fastened to an intermediate point on said first arm and a second end connected to means for taking up and paying out said cord-like member, said take-up and pay-out means being provided outside the furnace.

8. A hot repairing apparatus as claimed in claims 1, 2, 3 or 4, wherein said second drive means comprises a cord-like member having a first end fastened to an intermediate point on said second arm and a second end connected to means for taking up and paying out the cord-like member, said take-up and pay-out means being provided outside the furnace.

9. A hot repairing apparatus as claimed in claims 1, 2, 3 or 4, comprising two said second arms attached to said second end of said first arm to extend therefrom in opposite directions.

10. A hot repairing apparatus as claimed in claims 1, 2, 3 or 4, wherein said nozzle means comprises a plurality of vertically arranged gunning nozzles provided at said second end of said second arm.

11. A hot repairing apparatus as claimed in claims 1, 2, 3 or 4, wherein said nozzle means comprises a plurality of horizontally arranged gunning nozzles provided at said second end of said second arm.

12. A hot repairing apparatus as claimed in claims 1, 2, 3 or 4, further comprising a hydraulic cylinder reciprocatingly connecting said nozzle means to said second arm.

13. A hot repairing apparatus as claimed in claims 1, 2, 3 or 4, wherein said supply means comprises means for pressure feeding powder provided outside the furnace and a pressure hose connecting the pressure feeding means with said gunning nozzle means.

14. A hot repairing apparatus as claimed in claims 1, 2, 3 or 4, wherein the opening is an existing manhole in the blast furnace.

* * * * *